US008821662B2

(12) United States Patent
Mader

(10) Patent No.: US 8,821,662 B2
(45) Date of Patent: Sep. 2, 2014

(54) METHOD FOR PRODUCING INSULATING GLASS THAT IS FILLED WITH A GAS THAT IS DIFFERENT FROM AIR

(75) Inventor: Leopold Mader, Neuhofen/Ybbs (AT)

(73) Assignee: LISEC Austria GmbH, Seitenstetten (AT)

( * ) Notice: Subject to any disclaimer, the term of this patent is extended or adjusted under 35 U.S.C. 154(b) by 336 days.

(21) Appl. No.: 13/501,664

(22) PCT Filed: Aug. 2, 2011

(86) PCT No.: PCT/AT2011/000322

§ 371 (c)(1),
(2), (4) Date: Apr. 12, 2012

(87) PCT Pub. No.: WO2012/037585

PCT Pub. Date: Mar. 29, 2012

(65) Prior Publication Data

US 2012/0199272 A1 Aug. 9, 2012

(30) Foreign Application Priority Data

Sep. 23, 2010 (AT) ..... 1585/2010

(51) Int. Cl.
*E06B 3/677* (2006.01)

(52) U.S. Cl.
CPC ..... *E06B 3/6775* (2013.01)
USPC ..... 156/99; 156/109; 141/4

(58) Field of Classification Search
USPC ..... 141/1, 4; 156/99, 109
See application file for complete search history.

(56) References Cited

U.S. PATENT DOCUMENTS

| | | | | | |
|---|---|---|---|---|---|
| 436,984 | A | | 9/1890 | Mahaffey | |
| 4,369,084 | A | * | 1/1983 | Lisec | 156/382 |
| 4,886,095 | A | * | 12/1989 | Lisec | 141/4 |
| 4,921,022 | A | | 5/1990 | Lisec | |
| 5,110,337 | A | * | 5/1992 | Lisec | 65/58 |
| 5,350,469 | A | * | 9/1994 | Lenhardt et al. | 156/102 |

(Continued)

FOREIGN PATENT DOCUMENTS

| | | | |
|---|---|---|---|
| AT | 368 985 | A | 5/1981 |
| AT | 408 982 | B | 1/1992 |

(Continued)

OTHER PUBLICATIONS

International Search Report, dated Nov. 30, 2011, from corresponding PCT application.

(Continued)

*Primary Examiner* — Nicolas A Arnett
(74) *Attorney, Agent, or Firm* — Young & Thompson

(57) ABSTRACT

To fill insulating glass with a gas other than air, between the spacer (5) and the glass pane (3), an open space (15) for the entry of gas into the interior (7) of the insulating glass is ensured in that in the region of the cement strand (11), which is applied to the inside of the glass pane (3) or a side surface of the spacer (5), there are distance elements, for example in the form of projections (13) of the cement strand (11). These projections (13) are pressed into the cement strand (11) when the packet of panes consisting of (at least) two glass panes (3) with a spacer (5) inserted in between is being pressed to form an insulating glass blank (1), whereupon the insulating glass blank (1) is supplied to a sealing station for sealing.

15 Claims, 5 Drawing Sheets

(56) References Cited

U.S. PATENT DOCUMENTS

| | | | | |
|---|---|---|---|---|
| 5,413,156 | A * | 5/1995 | Lisec | 141/165 |
| 5,454,893 | A * | 10/1995 | Dietz | 156/104 |
| 5,476,124 | A * | 12/1995 | Lisec | 141/4 |
| 5,626,712 | A * | 5/1997 | Lisec | 156/497 |
| 5,645,678 | A * | 7/1997 | Lisec | 156/382 |
| 5,676,782 | A * | 10/1997 | Lisec | 156/109 |
| 5,704,405 | A * | 1/1998 | Lisec | 141/196 |
| 5,957,169 | A * | 9/1999 | Trpkovski | 141/63 |
| 6,068,720 | A * | 5/2000 | McHugh | 156/109 |
| 6,158,483 | A * | 12/2000 | Trpkovski | 141/63 |
| 6,916,392 | B2 * | 7/2005 | Trpkovski et al. | 156/104 |
| 7,299,844 | B2 * | 11/2007 | Lisec | 156/381 |
| 7,807,003 | B2 * | 10/2010 | Schuler | 156/109 |
| 2004/0182518 | A1 * | 9/2004 | Lisec | 156/382 |
| 2007/0068616 | A1 * | 3/2007 | Schuler | 156/109 |
| 2010/0199591 | A1 * | 8/2010 | Sonderkaer et al. | 52/656.6 |
| 2011/0017404 | A1 * | 1/2011 | Schuler | 156/497 |

FOREIGN PATENT DOCUMENTS

| | | | |
|---|---|---|---|
| AT | 399 145 | B | 3/1995 |
| AT | 399 500 | B | 5/1995 |
| AT | 409 128 | B | 5/2002 |
| DE | 2 229 523 | A1 | 12/1972 |
| DE | 31 39 856 | A1 | 12/1982 |
| EP | 0 324 333 | A2 | 7/1989 |
| EP | 0 389 706 | A2 | 10/1990 |
| EP | 1 412 604 | B1 | 8/2009 |

OTHER PUBLICATIONS

Austrian Office Action, dated Jul. 7, 2011, from corresponding Austrian application.

* cited by examiner

METHOD FOR PRODUCING INSULATING GLASS THAT IS FILLED WITH A GAS THAT IS DIFFERENT FROM AIR

TITLE OF THE INVENTION

The invention relates to a method for filling insulating glass with a gas other than air (heavy gas, for example sulfur hexafluoride, a rare gas, or mixtures of air with different gases).

BACKGROUND OF THE INVENTION

1. Field of the Invention

Various methods for the filling of insulating glass with heavy gas are known in the prior art. Examples are the methods and devices that are shown and described in AT 368 985 B (=DE 31 39 856 A and U.S. Pat. No. 4,369,84 A), EP 0 324 333 A, AT 399 500 B, AT 408 982 B and AT 409 128 B.

2. Description of the Related Art

In the known methods for filling insulating glass with a gas other than air, it is problematical that at least in the region through which the gas is to be added to the interior of the insulating glass, where therefore gas exchange is to take place, there must be a space between the spacer and at least one of glass panes. In practice, this is often achieved such that a glass pane is held in the gas-filling device at a distance from the surface of the spacer facing it by its being sucked onto a negatively-pressurized plate of the gas-filling device and being held by it.

The object of the invention is to devise a method with which the distance between at least one of the glass panes and the spacer can be achieved without a glass pane being sucked onto a plate of a gas-filling device and thus having to be held at a distance from the spacer.

This object is achieved according to the invention with a method that has the features of Claim 1.

BRIEF SUMMARY OF THE INVENTION

Preferred and advantageous configurations of the invention are the subject matter of the dependent claims.

Since, in the method according to the invention in the region of the spacer, there are distance means that are active only during the gas-filling process and that ensure the space between the spacer and the surface of the glass pane facing it during the filling process, it is no longer necessary to keep the glass pane at a distance from the spacer by its being held by a suction plate.

The distance means can be arranged distributed over the entire length of the spacer, or only in one region of the spacer, specifically in the region in which there should be an opening via which the interior space of the insulating glass is to be filled with gas.

The distance means can be elevations (projections) in the cement strand that is used to cement the glass pane to the spacer. These elevations in regions can be thickenings of the cement strand or else distance means that are placed on the cement strand and that can be pressed into it. If the spacers consist of thermoplastic or elastoplastic material, the distance means can be pressed into the spacer.

Alternatively, it can be provided that the distance means are distance means that are placed on the edge of the glass pane and that are fixed there by clamping. These distance means are removed again after the filling process, yet before the pressing of the insulating glass.

If distance means (clips) placed on the edge of the glass pane are located outside of the cement (butyl rubber) strand, i.e., touch only the region of the spacer that is not occupied by cement, they can also remain in place after the pressing of the insulating glass, and it is sufficient if the distance means are removed before the sealing of the insulating glass (filling of the edge joint with sealing mass).

The method according to the invention is suitable not only for double-pane insulating glass, but also for triple-pane and multi-pane insulating glass, the cement strand being applied either to the spacer surfaces facing the outer glass panes and/or the inside of the glass panes. Here, distance means can also be elevations in the cement strand, distance blocks (plugs) placed on them, or else clips, as described above, or else distance means that can be pressed into the spacer (made of plastic).

When there are distance means in the region of the cement strand, i.e., elevations thereof or plugs seated on them, it is advantageous if the distance means have a dimension such that they are pressed in the cement strand when the insulating glass is pressed after the gas-filling process so that the cement strand can perform its function as a diffusion barrier.

One advantage of the method according to the invention is also that gas-filling devices (gas-filling presses) that are known in the art can be used, for example the gas-filling devices disclosed in the aforementioned documents, with only the lifting of one glass pane in order to attain an opening for the entry of gas into the interior of the insulating glass between the pane and the spacer able to be omitted.

BRIEF DESCRIPTION OF THE DRAWINGS

Other details and features of the invention will become apparent from the following description of embodiments using the drawings.

DETAILED DESCRIPTION OF THE PREFERRED EMBODIMENTS

Figure 1:
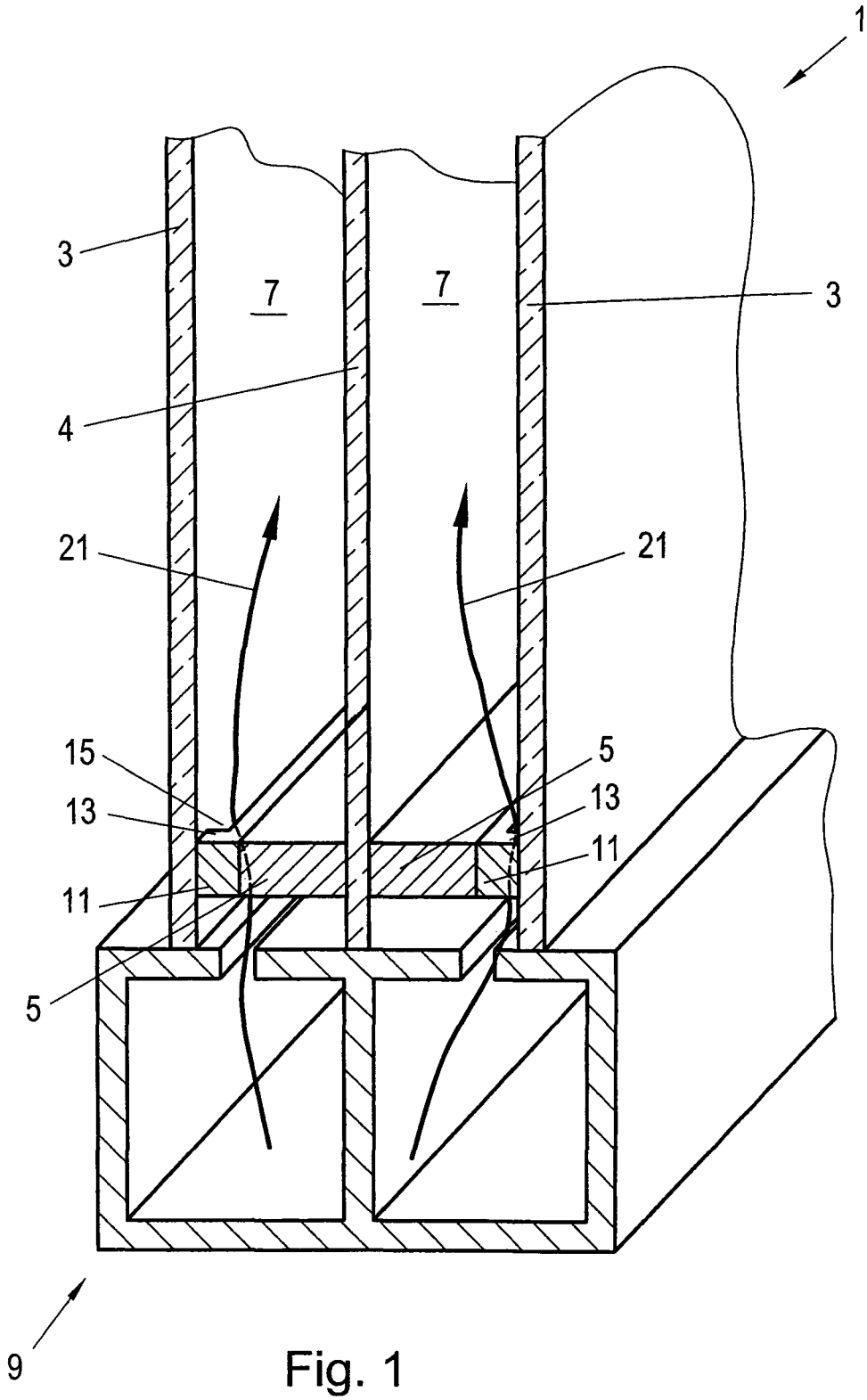
FIGS. 1 to 4 show—in schematic oblique views—various embodiments of triple insulating glass, the method according to the invention for filling the interior of the insulating glass with gas being shown schematically, and FIGS. 5 to 7 showing embodiments with distance means on a spacer made of plastic.

In the embodiment of the filling of triple-pane insulating glass 1 shown in FIG. 1, which glass is present in FIG. 1 as a "blank" consisting of a packet of three glass panes 3, 4 and spacers 5, with a gas (heavy gas) other than air, the gas is routed from a double channel 9 into both interior spaces 7 between the outer glass panes 3 and the middle glass pane 4. In the embodiment shown in FIG. 1, on the middle glass pane 4, two spacers 5 are mounted that on their surfaces facing the outer glass panes 3 bear a strand 11 made of diffusion-tight cement, for example butyl cement, with projections 13 (distance of the projections 13 from one another roughly 50 to 500 mm). This ensures that between the outer glass panes 3 and the spacers 5, which are located on the inner glass pane 4 (middle glass pane), open spaces 15 remain through which the gas can flow out of the double channel 9 into the interior spaces 7, as is symbolized in FIG. 1 by arrows 21.

As soon as the filling process is ended, i.e., the desired degree of filling of the interior spaces 7 with heavy gas has been achieved, the supply of gas is cut off. The outer glass panes 3 are pushed toward one another in a press that can at the same time be the device for filling with heavy gas (gas-filling press), so that they adjoin the strands 11 on the two spacers 5; in doing so, they deform the projections 13 and ultimately rest flat on the strands 11.

The insulating glass (blank) that has been pressed in this way is then supplied to a device for filling the edge joint with sealing mass (automatic sealing unit) in which sealing mass (generally a polysulfide-based mass) is injected into the two edge joints that are bordered to the inside by the spacers 5 and laterally by the glass panes 3 and 4.

Figure 2:
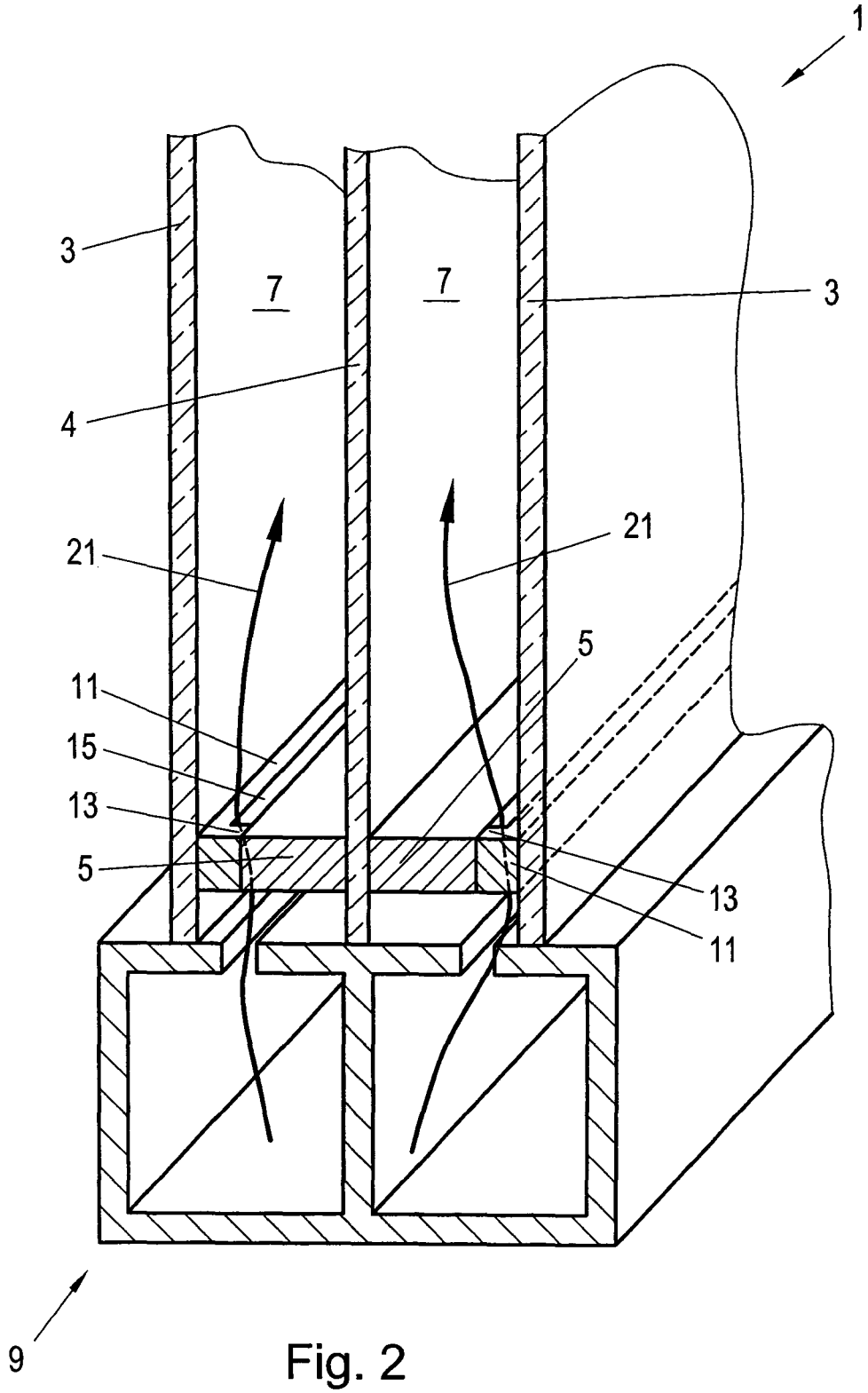

The embodiment shown in FIG. 2 differs from the one shown in FIG. 1 in that the strands 11 made of cement (butyl rubber) are not applied to the spacers 5, but rather to the insides of the outer glass panes 4. Here, there are also projections 13 on the surfaces of the cement strands 11 that point to the spacers 5, and during the gas-filling process, they ensure a distance between the spacers 5 and the outer glass panes 4 so that gas can flow into the interior spaces 7 between the glass panes 3 and 4.

Figure 3:
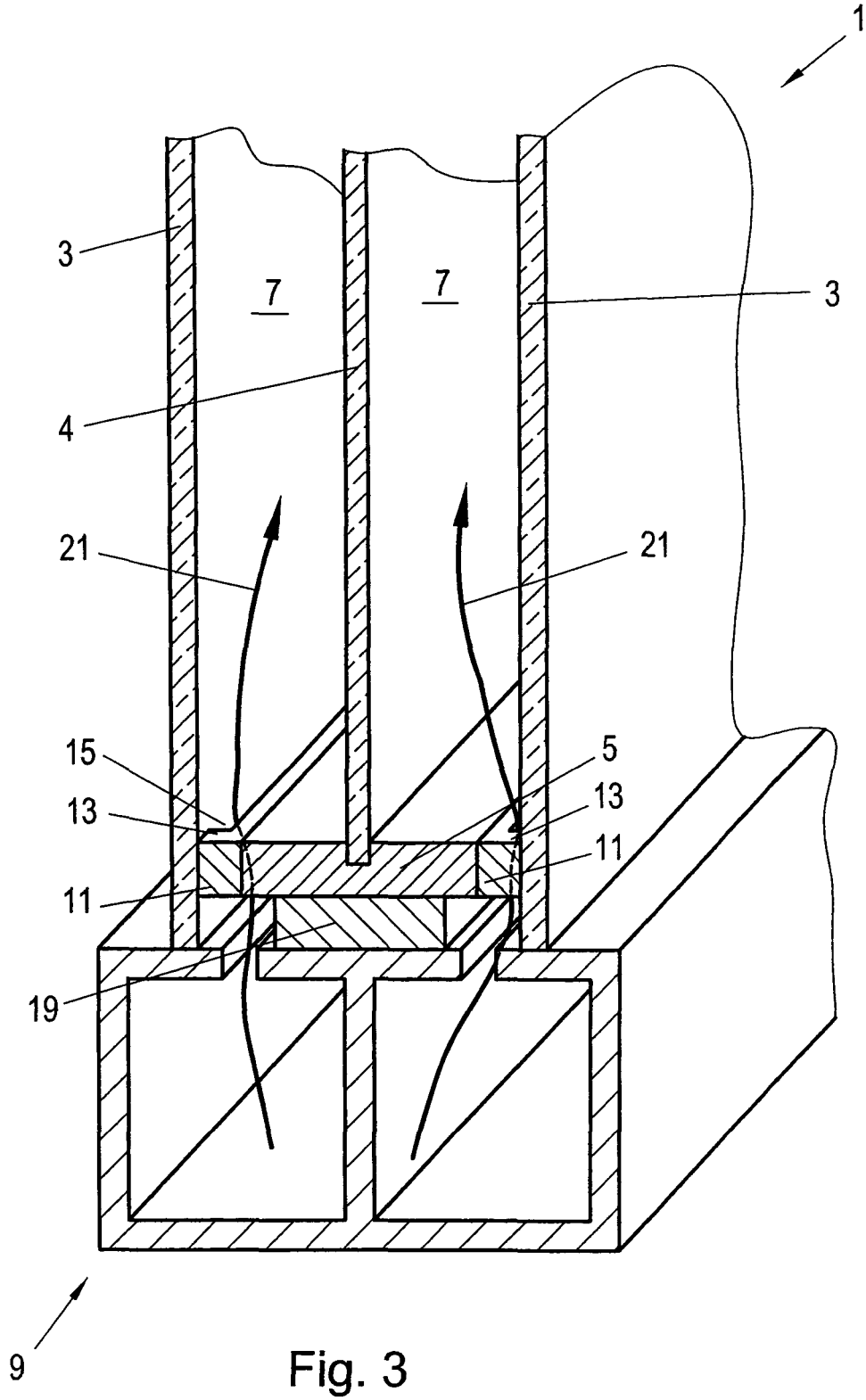

FIG. 3 shows an embodiment that is fundamentally similar to the arrangement of FIG. 1, here the spacers 5 being combined into one spacer 5 and the middle glass pane 4 projecting only as far as into the spacer 5. In order to support the middle glass pane 4 and the spacer 5 during the filling process, there is a support strip 19 on the double channel 9 from which the gas is supplied. Individual support projections can also be attached to the double channel 9 in place of the support strip 19.

Figure 4:
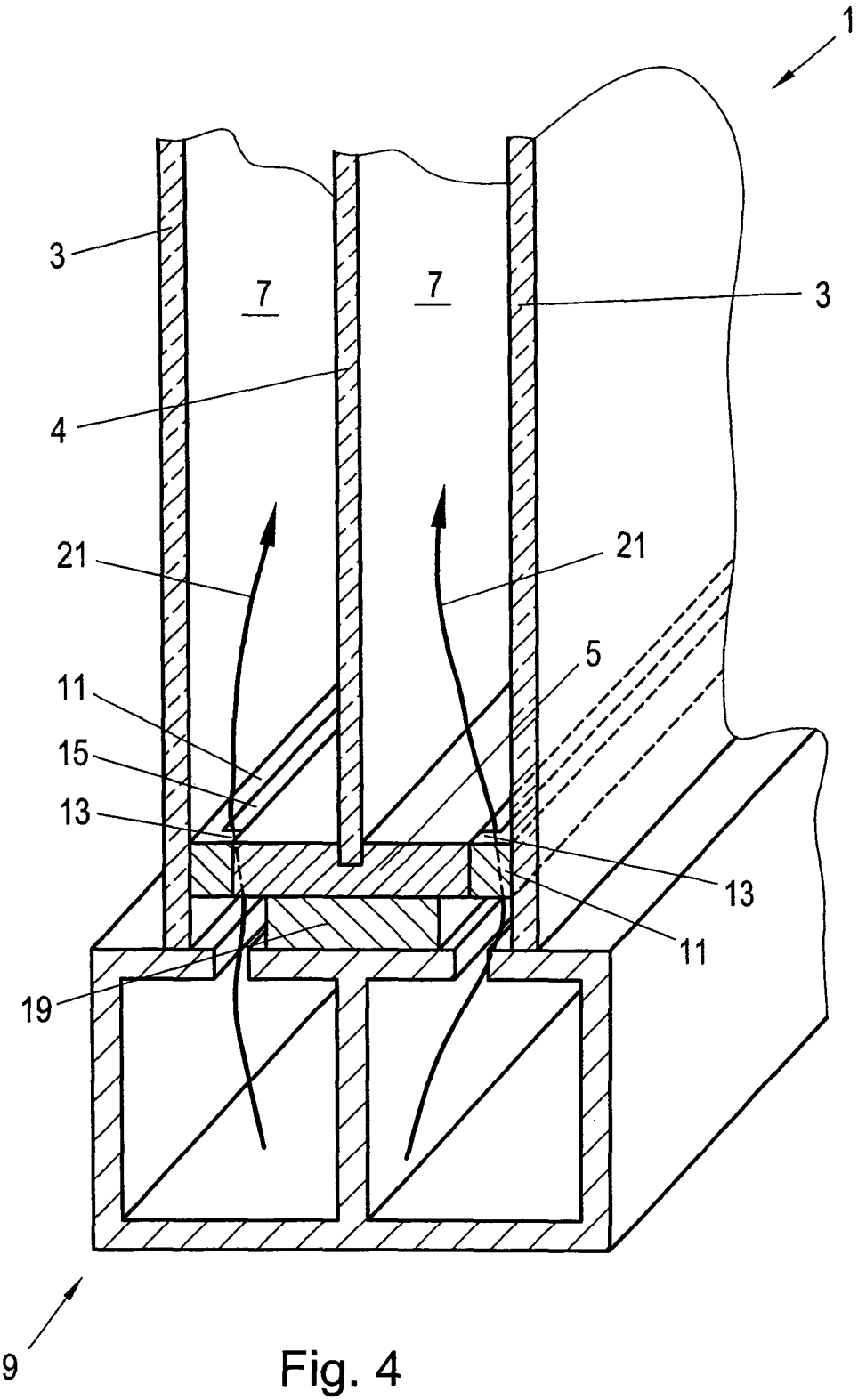

The embodiment shown in FIG. 4 differs from the one shown in FIG. 3 in that the cement strands 11 are not attached to the outer surfaces, i.e., the surfaces of the spacer 5 that face the outer glass panes 3, but to the internally pointing surfaces of the outer glass panes 3.

Instead of the projections 13 that are formed by elevations of cement strands 11, distance means in the method according to the invention can also be distance means seated on the cement strands 11 in the form of buttons, plugs or the like that are pressed into the strands 11 when the insulating glass is being pressed (as described above) after the filling process has ended.

An embodiment is also considered in which there are cement strands 11 both on the outer glass panes 3 and also on the surfaces of the spacer/spacers 5 pointing to the outside.

Instead of the embodiment that is shown in FIGS. 1 to 4, in which the distance means—which are temporarily active, i.e., only during the filling process, in order to form at least in one region a gap-shaped opening between the spacer 5 and one of the outer glass panes 3—are projections 13 in the form of elevations of the cement strand 11, or distance means that are seated on the cement strand 11, within the framework of the invention distance means can also be used that are seated on the edge of at least one of the glass panes 3 (in a double-pane insulating glass on at least one of the glass panes) in order to ensure distance between the outer surface of the spacer 5 and the glass panes 3 in order in this way to form gap-shaped openings for gas exchange. These distance means can be elastic distance means that act on the spacer 5 only in a region that lies outside of the region of the spacer 5 that is coated with the cement strand 11.

These distance means are removed at the latest before the blank is sealed.

When the distance means rest on the spacer 5 in the region of the cement strand 11, they are removed before the packet of at least two glass panes 3, 4 and spacers 5 is pressed to form a blank of insulating glass.

Figure 5:
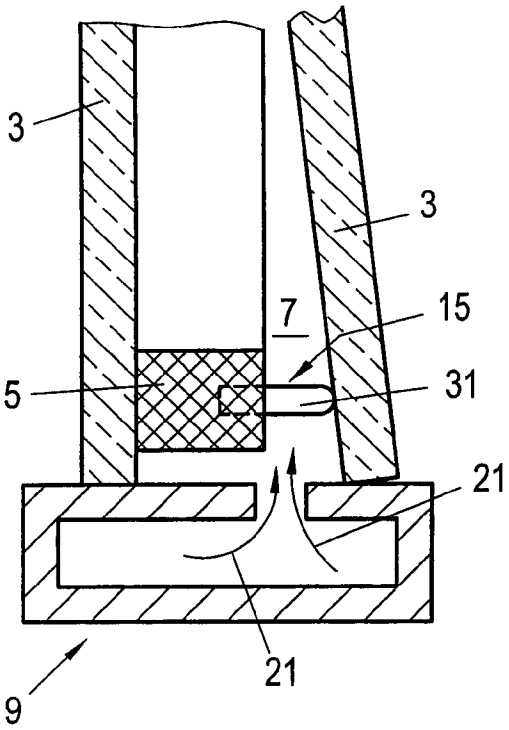

In the embodiment shown in FIG. 5, the spacer 5 between the glass panes 3 is a plastic spacer 5. Such plastic spacers 5 are known from, for example, DE-A 30 02 904 and are often called "swiggle strips." This spacer 5 has the shape of a strip with a rectangular cross-section that—provided with protective films—is withdrawn from a feed drum and is applied to the glass pane 3 by means of an application device. Strip-shaped spacers 5 based on butyl rubber are viscous like plastic and highly adhesive, so that a gas-tight connection between the glass panes 3 of the insulating glass is possible.

Spacers 5 made of elastoplastic plastic based on polyurethane or the like are also known. These spacers 5 likewise have a rectangular cross-section and on their subsequent outer side bear a diffusion barrier, for example a layer of aluminum foil. These elastoplastic spacers 5 are provided on their narrow sides intended for contact with the glass panes 3 at the manufacturer with a thin coating of a highly adhesive cement that is covered with protective film until the spacer is applied.

In the embodiment shown in FIG. 5, a row of pins 31 as distance means is inserted into the plastic spacer 5, first of all such that the free ends of the pins 31 project in the direction to the glass pane 3—on which the spacer 5 is not yet resting for the time being—and keep the glass pane 3 at a distance from the spacer 5. After the filling process of the interior space 7 with gas, the pins 31 are pressed into the plastic spacer 5 and are surrounded by it when the insulating glass is assembled and pressed.

Figure 6:
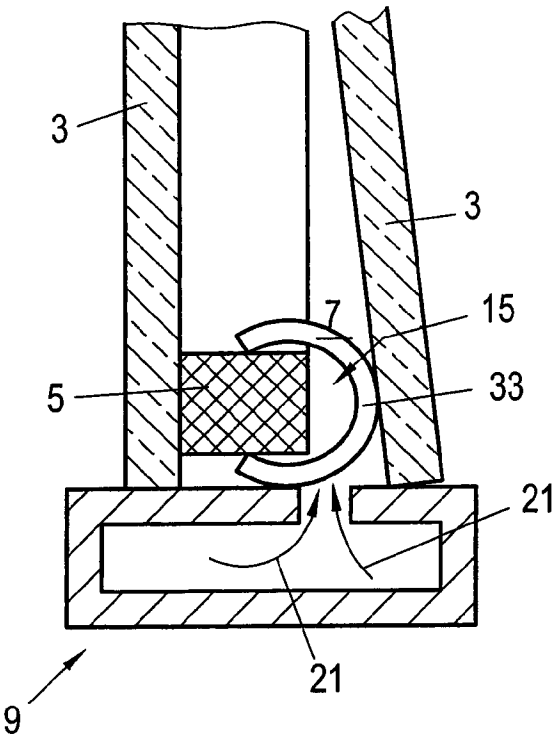

In the embodiment shown in FIG. 6, the distance means are several essentially U-shaped brackets (clips) 33 that are seated on the spacer 5 and that adjoin the outside and inside of the spacer 5 by frictional clamping and thus define the distance for forming the empty space 15 that forms the fill gap. The brackets 33 are also pressed into the spacer 5 and are surrounded by it when the insulating glass is pressed.

Figure 7:
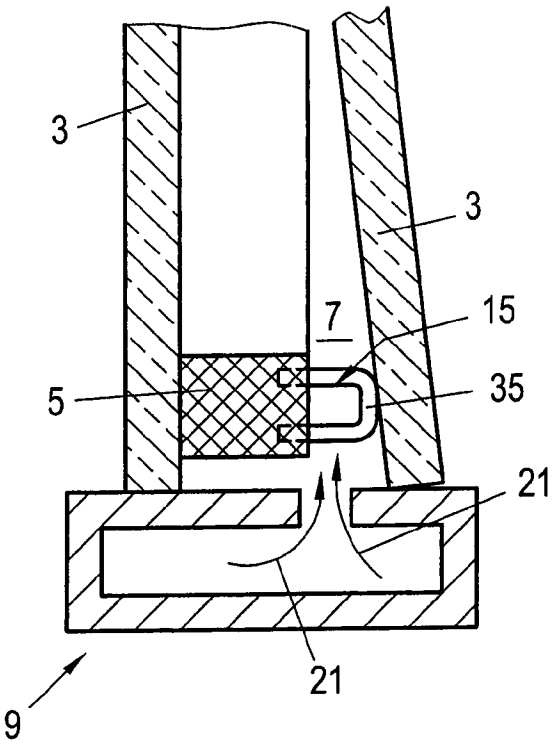

In the embodiment shown in FIG. 7, the distance means are U-hooks 35 that are inserted into the spacer 5 first of all only so far that their web adjoins the glass pane 3 that is opposite the spacer 5 that is attached to the other glass pane 3 in order to form the open space 15 for gas passage. When the insulating glass is being pressed, the distance means in the form of U-hooks 35 are also pressed into the spacer 5 and are surrounded by its material so that, as in the embodiments of FIGS. 5 and 6, a diffusion-tight connection of the glass panes 3 to the spacer 5 is achieved.

In summary, one embodiment of the invention can be described as follows:

To fill the insulating glass with a gas other than air, between the spacer 5 and the glass pane 3 an open space 15 for the entry of gas into the interior 7 of the insulating glass is ensured in that in the region of the cement strand 11 that is applied to the inside of the glass pane 3 or a side surface of the spacer 5, there are distance means, for example in the form of projections 13 of the cement strand 11. These projections 13 are pressed into the cement strand 11 when the packet of panes consisting of (at least) two glass panes 3 with a spacer 5 inserted in between is being pressed to form an insulating glass blank 1, whereupon the insulating glass blank 1 is supplied to a sealing station for sealing.

The invention claimed is:

1. A method for filling insulating glass with a gas other than air or with a gas mixture, comprising the steps of:

inserting a spacer (5) between glass panes of a packer of at least two glass panes (3, 4), the spacer (5) being inserted in at least one region of an edge of the packet of at least two glass panes (3, 4);

with a distance means (13, 31, 33, 35), making an open space (15) between the spacer and one of the glass panes (3, 4) in a form of a gap-shaped opening; and performing a gas-filling process by carrying out an exchange of gas for air through the open space (15) to fill an interior space (7) between the glass panes with the gas, wherein the open space (15) formed by the distance means (13, 31, 33, 35) remains open only during the gas-filling process.

2. The method according to claim 1, wherein the distance means comprise projections (13) of a cement strand (11) located on at least one of i) the spacer (5) and ii) the one glass pane (3, 4).

3. The method according to claim 1, wherein, the distance means comprise distance holders seated on a surface of a cement strand (11) facing the one glass pane (3, 4) and the distance holders are pressed into the cement strand (11) when the packet of the at least two glass panes (3, 4) and the spacer (5) inserted in between are pressed together to close the open space (15).

4. The method according to claim 1, wherein the distance means comprise distance holders attached to the edge of the one of the glass panes (3, 4) temporarily during the gas-filling process.

5. The method according to claim 1, wherein, the packet of at least two glass panes (3, 4) is a triple-pane insulating glass (1) with outer glass panes and a middle glass pane, the distance means (13, 31, 33, 35) are provided between the outer glass panes (3), and the spacer (5) is located projecting on both sides on the middle glass pane (4) in order to form gap-shaped open spaces (15) for gas exchange between the outer glass panes (3) and the spacer (5).

6. The method according to claim 5, wherein the distance means are cement strands (11) located on outer surfaces of the spacer (5).

7. The method according to claim 6, wherein the cement strands (11) are attached to inner surfaces of the outer glass panes (3).

8. The method according to claim 1, wherein, the spacer (5) is a one of the group consisting of a thermoplastic material and an elastoplastic material, and the distance means (31, 33, 35) comprise elements inserted into the spacer (5).

9. The method according to claim 8, wherein the distance means comprise pins (31) inserted into the spacer (5).

10. The method according to claim 8, wherein the distance means comprise U-shaped brackets (33) seated on the spacer (5).

11. The method according to claim 8, wherein the distance means comprise U-hooks (35) inserted into the spacer (5).

12. The method according to claim 8, wherein, to close the open space (15), the glass is pressed so that the distance means (31, 33, 35) are pressed into the spacer (5) and surrounded by the spacer (5).

13. The method according to claim 1, wherein the spacer (5) is a thermoplastic material and the distance means (31, 33, 35) comprise elements placed on the spacer (5).

14. The method according to claim 1, wherein the spacer (5) is an elastoplastic plastic material and the distance means (31, 33, 35) comprise elements placed on the spacer (5).

15. The method according to claim 1, wherein completing the gas-filled process includes closing the open space (15) formed by the distance means (13, 31, 33, 35).

* * * * *